US006105343A

United States Patent [19]

Grove et al.

[11] Patent Number: 6,105,343

[45] Date of Patent: Aug. 22, 2000

[54] APPARATUS AND METHOD FOR A CAPPING MACHINE

[75] Inventors: Michael A. Grove, Copley; Scott A. McSherry, Uniontown; David W. Liebal, Seven Hills, all of Ohio

[73] Assignee: Pneumatic Scale Corporation, Cuyahoga Falls, Ohio

[21] Appl. No.: 09/187,961

[22] Filed: Nov. 6, 1998

[51] Int. Cl.[7] ..... B65B 7/28

[52] U.S. Cl. ..... 53/490; 53/75; 53/317; 53/331.5

[58] Field of Search ..... 53/75, 331.5, 317, 53/490

[56] References Cited

U.S. PATENT DOCUMENTS

| | | | |
|---|---|---|---|
| 4,608,805 | 9/1986 | Kelly . | |
| 4,614,077 | 9/1986 | Muto et al. . | |
| 4,616,466 | 10/1986 | Tanaka | 53/331.5 |
| 5,127,449 | 7/1992 | Mueller et al. . | |
| 5,152,182 | 10/1992 | Searle . | |
| 5,321,935 | 6/1994 | Spatz | 53/75 |
| 5,400,564 | 3/1995 | Humphries et al. . | |
| 5,415,050 | 5/1995 | Trendel et al. . | |
| 5,419,094 | 5/1995 | Vander Bush, Jr. | 53/317 |
| 5,526,725 | 6/1996 | Tremaglio et al. . | |

FOREIGN PATENT DOCUMENTS

| | | | |
|---|---|---|---|
| 4-189793 | 7/1992 | Japan | 53/331.5 |

*Primary Examiner*—John Sipos

*Attorney, Agent, or Firm*—Daniel D. Wasil; David R. Percio; Ralph E. Jocke

[57] ABSTRACT

A capping machine (10) and method for installing a cap (12) having a threaded portion onto a container (14) having a threaded portion, the threaded portion of the cap corresponding to the threaded portion of the container, the capping machine having a rotatable turret (20) and a rotatable cap chuck (16) which grips the cap and positions the cap on the container. The cap chuck is rotated by a spindle (22) driven by a servo motor (24) at adjustable and reversible rotational velocities independent of the rotational velocity of the turret. The number of rotations of the cap is determined by monitoring the number of rotations of the servo motor compared to the number of rotations of the turret and is transmitted to a spindle drive control(70). The torque imparted to the cap is monitored by a torque monitor (50) and is transmitted to the spindle drive control. The rotational velocity of the cap is adjustable in response to the compared monitored number of rotations and monitored torque. The capped container is released from the cap chuck after a selected number of rotations of the cap onto the container has been made. Caps applied outside a selected range of monitored torques and number of rotations are tracked and rejected.

22 Claims, 2 Drawing Sheets

APPARATUS AND METHOD FOR A CAPPING MACHINE

TECHNICAL FIELD

This invention relates to installing screw caps on threaded containers. More specifically this invention relates to an apparatus and method for installing screw caps on threaded containers using a selected number of cap rotations and simultaneously monitoring a controllable and verifiable application torque.

BACKGROUND ART

Threaded caps used to seal correspondingly threaded containers are generally known as screw caps. Screw caps for containers are ideally tightened at a predetermined torque. This w torque is selected to close the container sufficiently tightly to avoid loss, deterioration or contamination of the contents during transportation and storage. However, the cap must not be so tightened that it cannot be opened manually. Also it must not be so tightened that either the cap or the container or both are damaged. The position of the threaded cap on the corresponding threads of the container determines when the cap has been properly installed on the container. This position is determined by the number of rotations made be the cap once the threads have engaged.

Capping machines for screwing threaded caps onto containers typically have a rotatable turret around the circumference of which are multiple spindles. Each spindle is caused to rotate by the rotation of the turret or a separate drive motor. All spindles turn at the same rotational velocity. Each spindle has a clutch coupled to a capping chuck at its lower end. The capping chuck may be of the magnetic, spring or friction type.

To install a cap on a container the container is held in position. A cap is held in the chuck, which is lowered toward the container. The chuck is rotated by the spindle in a direction to tighten the cap. When the cap engages the container the rotation is continued and the cap engages the container threads. Rotation of the cap continues and the cap is tightened onto the container threads. A clutch set to slip at a selected torque prevents the cap from being over tightened. After a selected time period of cap rotation, the chuck is retracted as the spindle moves upward. The next container is then presented for capping.

Caps of different sizes and materials are installed on their corresponding containers using different torques to achieve desired tightness. Tightness of the cap is controlled generally by maintaining a constant spindle rotational velocity and adjusting the clutch. In addition to the torque setting of the clutch the rotational inertia of the chuck, where it is in contact with the cap, contributes to the final tightness. The clutch setting may be set at a selected value, but the rotational inertia varies with the rotational velocity of the spindle.

A sufficient number of spindle turns is required to achieve a selected or target torque. This number of turns is generally determined by the amount of thread engagement between the cap and the container. Too small a number of spindle turns results in insufficient thread engagement between the cap and the container. This results in insufficient tightness of the cap. Too large a number of spindle turns results in excessive slipping in the clutch, thereby resulting in less consistent torque control and less efficient cap application.

High speed operation of the capping machine results in high angular velocities of the spindle and the chuck, which may result in over-tightening of the cap. There has been no method of measuring actual application torque directly from the chuck, spindle or turret and thereby determining during the capping operation at which point in the capping cycle a selected application torque has been reached. Quality control testing must be performed to assure that application torque has not changed during a capping operation, as may occur due to calibration drift and wear in the mechanical components.

Acceptable tightness is determined by running a number of containers through the capping process, then measuring the torque required to remove the cap. This removal torque must be correlated to an application torque for setting the capping machine. A number of iterations may be required to set the proper application torque. This arbitrary calibration may vary from machine to machine. It may also be difficult to maintain uniformity between the various spindles on a turret.

It is difficult to maintain constant application torque based on the arbitrary calibration. Changes in spindle rotational velocity, temperature related changes in frictional coefficients of the cap and container, and changes in the clutch, particularly in friction clutches, during operation can cause changes in application torque. Changing any of the variables of capping machine speed, cap or container size or thread configuration, temperature or other variables, requires recalibration of the machine by a skilled operator and results in lost production time.

Capping machines of the prior art have been made to run at a constant spindle speed to help maintain constant application torque. However, cross-threading or defective threads, even with constant spindle speed, can cause a selected application torque to be reached and clutch slipping to occur as desired, but resulting in an undetected defectively capped container. Running a capping machine at constant spindle speed longer than necessary to tighten the cap results in acceptable application torque because the clutch slips. However, excessive clutch wear can occur when the clutch slips for longer than necessary.

Thus there exists a need for a method and apparatus which permits quick, efficient and convenient screw cap closing of a threaded container to a preselected tightness by threading a screw cap to a selected position onto a threaded container with a selected number of rotations with a controllable and verifiable application torque.

DISCLOSURE OF INVENTION

It is an object of the present invention to monitor the position of a screw cap as it is threaded onto a threaded container based on the number of rotations of the cap.

It is a further object of the present invention to monitor application torque as a screw cap is threaded onto a threaded container It is an object of the present invention to monitor the position and application torque of a screw cap held on a rotating spindle as the cap is threaded onto a threaded container.

It is a further object of the present invention to monitor the position and application torque of a screw cap, to correlate the monitored position and application torque with selected values, and to use the correlated monitored position and application torque to control further application torque as the screw cap is further threaded onto a threaded container.

It is a further object of the present invention to monitor the position and application torque of a screw cap and determine at which point during the capping cycle a target application torque is reached.

It is a further object of the present invention to use the monitored position and application torque to control further application torque of the screw cap by adjusting the spindle rotational velocity.

It is a further object of the present invention to monitor the position and application torque of a screw cap and to use the monitored application torque to control further application torque of the screw cap by adjusting the spindle rotational velocity independent of the turret rotational velocity.

The foregoing objects are accomplished in a preferred embodiment of the invention by a capping machine having a rotatable turret supporting multiple spindles operable at rotational velocities independent of turret rotational velocity and adjustable in response to monitored position and application torque of a screw cap on a threaded container.

Further objects of the present invention will be made apparent in the following Best Mode For Carrying Out Invention and the appended claims.

BEST MODE FOR CARRYING OUT INVENTION

Figure 1:
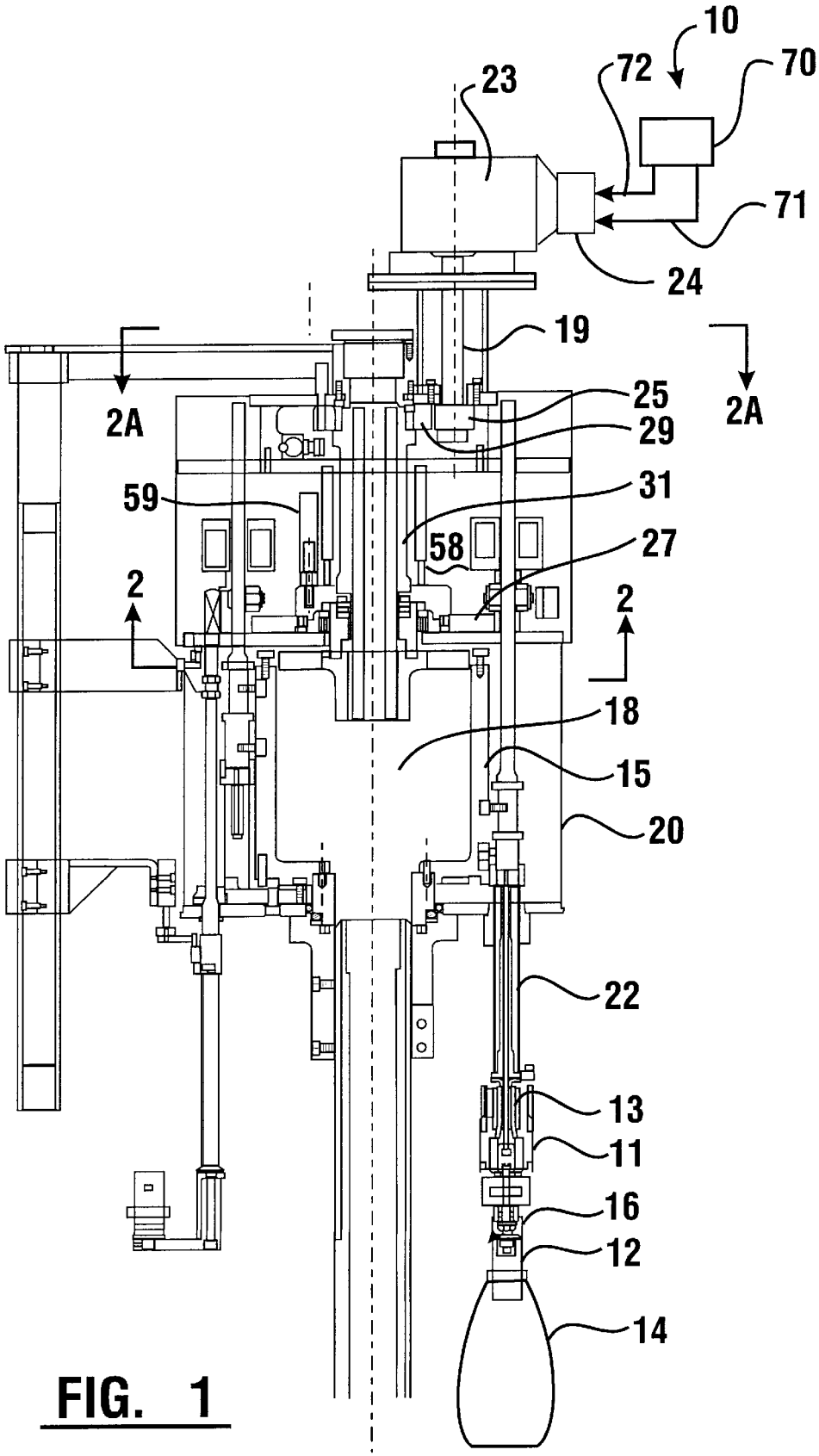
FIG. 1 is a side elevational view of one embodiment of a capping machine of the present invention.

A preferred embodiment of the capping machine 10 of the present invention is shown in FIG. 1. Capping machine 10 has a stationary center shaft 18 around which a turret 20 is rotatably mounted. Turret 20 is rotated by a motor (not shown) whose rotational velocity is adjustable to vary the rate at which containers are processed by the capping machine. A plurality of spindles 22 are supported circumferentially about the turret. A clutch 11 and a cap chuck 16 are positioned at a lower end of each spindle 22.

Spindles 22 are moved upwardly and downwardly parallel to center shaft 18 by a cam 15. In alternative embodiments spindles 22 may be moved upwardly and downwardly parallel to center shaft 18 by a servo motor. Cap chuck 16 may be positioned precisely in a vertical position for containers 14. For subsequent capping operations of containers of a different size, cap chuck 16 may be positioned in the correct vertical position for the capping of that size container.

A threaded cap 12 has threads of a size, pitch and depth corresponding to the threads of a threaded container 14. Cap 12 is held in cap chuck 16. Cap chuck 16 positions cap 12 onto container 14. Cap chuck 16 is rotatably driven through clutch 11 to rotate cap 12. When a selected torque is attained, clutch 11 begins to disengage. A rod 13 actuated by cam 15 causes cap chuck 16 to open. Cap 12 is released by cap chuck 16, and container 14 is moved out of the capping machine. This capping cycle is well known.

As shown in FIG. 1 a spindle drive motor 24 drives a gearbox 23. Spindle drive motor 24 in this embodiment is a servo motor which drives gearbox 23 independent of turret rotational velocity. Gearbox 23 has a center shaft 19, which drives a pinion 25. Pinion 25 drives a spindle drive gear 27 through a transfer gear 29 and a drive tube 31. Spindle drive gear 27 determines the rotational velocity of spindles 22. Spindle drive motor 24 is controllable to vary the rotational velocity of spindles 22 and thereby to control the application torque of cap 12 onto container 14. Spindle drive motor 24 is reversible, that is, it may turn in a clockwise or counterclockwise direction. Capping machine 10 may be thus used in a right handed or left handed capping operation.

For given size, pitch and depth of the threads of cap 12 and the corresponding threads of container 14, imparting a selected amount of rotations to cap 12 on container 14 causes cap 12 to move to a selected position on container 14. The amount of rotation of cap 12 determines the position of cap 12 on container 14. In this way completion of capping is determined. Too little rotation of cap 12 onto container 14 will result in an insufficiently capped container. Too much rotation of cap 12 onto container 14 will result in a damaged cap or container or both. Clutch 11 is set to disengage or slip at a specified application torque to prevent cap 12 from being applied with too rotation onto container 14 to prevent such damage.

Spindle drive control 70 includes a processor having circuitry capable of receiving input data related to motor speeds, computing operational characteristics and generating control commands, as is well known in motor control applications. Spindle drive control 70 monitors spindle drive motor 24 operating at a first speed, normally expressed in revolutions per minute. The amount of rotation of turret 20 is monitored by an encoder (not shown) mounted on the turret drive motor and communicated to the spindle drive control 70. As the speed of the turret drive motor changes thereby changing the rotational velocity of turret 20, the spindle drive control 70 processor computes a second speed for spindle drive motor 24 to maintain a constant amount of rotation and rotational velocity for spindles 22. This second speed is communicated as a control command by spindle drive control 70 through a communications link 71 to spindle drive motor 24. Power is supplied to spindle drive motor 24 through a power link 72. In this way the amount of rotation of cap 12 onto container 14 is controlled by spindle drive control 70. In alternative embodiments an encoder could be used to monitor directly the rotation of spindles 22 and therefore the rotation of cap 12.

In this embodiment communications link 71 and power link 72 are hard wired connections. In other embodiments communication link 71 may be a wireless communications link including radio, infrared, laser, photo-optical or other transmission modes.

As described above, capping is complete when a selected amount of rotation of cap 12 has been made as it is threaded onto container 14. When the selected amount of rotation of cap 12 has been reached, spindle drive control 70 generates a control command to spindle drive motor 24 and the rotational velocity of spindles 22 is reduced. Reducing the rotational velocity of spindles 22 also reduces the application torque. Slowing or stopping the rotation of spindle 22, and thereby of chuck 16 and cap 12, reduces or eliminates clutch slipping and excessive or premature clutch wear.

Prior art capping machines operate to maintain a constant spindle speed. The apparatus of the present invention maintains a constant amount of revolution of each spindle 22 and each cap 12 for each revolution of turret 20. This constant amount of revolution of spindles 22 is maintained independent the rotational velocity of turret 20. In this way the cap is properly positioned on the container in the time selected for each capping cycle.

Figure 2:
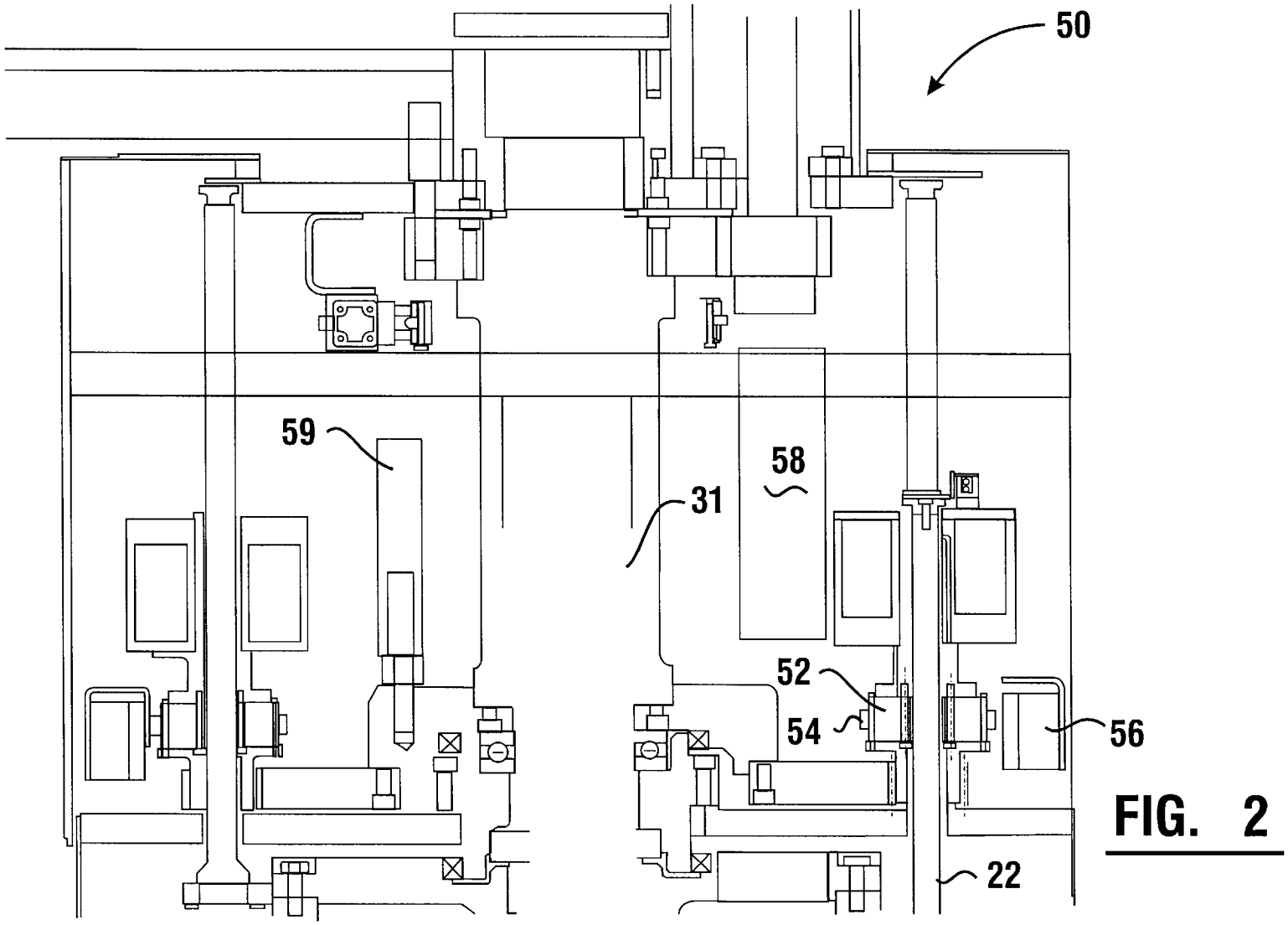
FIG. 2 is an enlarged side elevational view above a line indicated 2—2 and below a line indicated 2A—2A in FIG. 1 showing a torque monitoring system portion of the capping machine shown in FIG. 1.

Torque monitor 50 is shown in FIG. 2. A strain gauge 52 is splined to the shaft of a spindle 22 in the preferred embodiment. The torque applied by cap chuck 16 through clutch 11 to cap 12 is detected by strain gauge 52, converted to electrical signals and transmitted by transmitter 54 to receiver 56. Converting strain gauge deflection to electrical signals is well known. For one example, resistance strain gauges may be connected in a Wheatstone bridge arrangement so that a torque applied to the shaft of spindle 22 operates on the resistance strain gauges to alter the output from the Wheatstone bridge. The output from the bridge is then amplified to a usable level. The amplified output is in analog form and may be converted to digital form with an analog-digital converter for convenience of calculations using the output data.

A large amount of torque data is obtained from the continuous monitoring of strain gauges 52 on each spindle 22. In the embodiment shown in FIG. 2 a multiplexer 58 selects packets of data from this large amount of torque data and the data packets are transmitted by radio to a receiver (not shown). However, all the data may be transmitted to a processor having sufficient computing power. Also, hard wired, infrared, laser, photo-optical or other transmission modes may also be used.

Reaching specified application torque before the specified number of rotations indicates a defective capping operation. Slipping of clutch 11 before sufficient rotations of cap 12 have been made occurs from attaining the specified application torque too soon. Problems such as cross-threading or defective or damaged threads on a cap or container preventing sufficient closing can result in specified application torque being reached too soon. Further, after sufficient rotation has been made and final application torque has been reached, rotation of chuck 16 causes slipping of clutch 1. Continued rotation of chuck 16 can result in excessive clutch wear.

Spindle drive control 70 controls the amount of rotation made by cap chuck 16 and cap 12 as described above. Spindle drive control 70 compares the amount of rotation of cap 12 with a selected amount of rotation stored in its memory for the proper position of cap 12 on container 14. Spindle drive control 70 further compares the monitored amount of rotation and the measured torque with a number or range of rotation amount and target torque values optimized for each cap and container combination and stored in its memory.

If the monitored torque value equals the target torque value before cap 12 has undergone the amount of rotation selected for complete closure, the container is tracked and rejected. If the selected amount of rotation has been made and the monitored torque is at the selected value or within a selected range of values, spindle drive motor 24 is controlled to adjust the speed of spindle 22. If the selected amount of rotation has been made and the monitored torque is not at the selected value or within a selected range of values, the container may be tracked and rejected. In some embodiments the speed of spindle 22 may be varied in response to monitored torque values to optimize application torque.

As previously described, for each cap and container combination a capping machine must be set up and calibrated to apply the cap to the container with the selected tightness. Spindle drive control 70 correlates the torque data from torque monitor 50 with the amount of rotation data monitored by spindle drive control 70 and adjusts the number or rotations and the rotational velocity of spindles 22. This permits the apparatus of the present invention to handle normal production variations and supplier variations in caps and containers to achieve more consistent torques than were possible with the prior art.

The combination of spindle 22 rotation monitoring and torque monitoring with adjustment of the amount of spindle rotation and spindle rotational velocity permits more efficient use of capping cycle time. The time available in a capping cycle is used more efficiently by using the lowest rotational velocity of spindles 22 to impart the selected amount of rotation to cap 12, thereby reducing the time clutch 11 slips, even as the rotational velocity of turret 20 increases or decreases.

After the selected amount of rotation of cap 12 onto container 14 has been made, container 14 is removed from capping machine 10 and new cap 12 and container 14 are introduced and the capping cycle is repeated.

Thus the new apparatus and method of the present invention achieves the above stated objectives, eliminates difficulties encountered in the use of prior devices and systems, solves problems and attains the desirable results described herein.

In the foregoing description certain terms have been used for brevity, clarity and understanding, however, no unnecessary limitations are to be implied therefrom because such terms are for descriptive purposes and are intended to be broadly construed. Moreover, the descriptions and illustrations herein are by way of examples and the invention is not limited to the exact details shown and described.

In the following claims any feature described as a means for performing a function shall be construed as encompassing any means capable of performing the recited function, and shall not be limited to the structures shown herein or mere equivalents.

Having described the features, discoveries and principles of the invention, the manner in which it is constructed and operated, and the advantages and useful results attained, the new and useful structures, devices, elements, arrangements, parts, combinations, systems, equipment, operations and relationships are set forth in the appended claims.

We claim:

1. An apparatus for installing a cap having a threaded portion on a container having a threaded portion, the threaded portion of the cap corresponding to the threaded portion of the container, the apparatus comprising:

a rotatable cap chuck, wherein the cap is positionable by the cap chuck in supported relation with the container;

a driver adapted to rotate the cap chuck, wherein the rotational velocity of the cap chuck is adjustable by the driver and a torque is imparted to the cap, wherein the torque is sufficient to rotate the threaded portion of the cap in screw tightening relation with the threaded portion of the container;

a first monitor, wherein the torque imparted to the cap is monitored;

a second monitor, wherein the amount of rotation of the cap is monitored;

a processor, wherein the processor is adapted to compare the monitored amount of cap rotation to a stored range of preferred amounts of cap rotation, and wherein the processor is adapted to compare the monitored torque to a stored range of preferred values of torque;

a controller, wherein the controller is adapted to control the driver, and wherein the rotational velocity of the cap is adjustable in response to the compared monitored torque and monitored amount of rotation;

a release adapted to disengage the cap from the cap chuck after a selected amount of rotation has been made.

2. The apparatus of claim 1 and further comprising a cam, wherein the cam positions the cap chuck.

3. The apparatus of claim 1 and further comprising a servo motor, wherein the servo motor positions the cap chuck.

4. The apparatus of claim 1 and further comprising a strain gauge, wherein the strain gauge is deformed by the imparted torque.

5. The apparatus of claim 1 and further comprising a plurality of strain gauges, wherein the strain gauges are deformed by the imparted torque.

6. The apparatus of claim 5 wherein the strain gauge deformation is communicated to the processor, and wherein the processor determines the magnitude of the imparted torque.

7. The apparatus of claim 6 wherein the processor communicates the magnitude of the imparted torque to the controller, and wherein the controller adjusts the imparted torque to a selected value.

8. The apparatus of claim 5 and further comprising a transmitter wherein the strain gauge deformation is communicated to the processor by wireless transmission.

9. The apparatus of claim 8 wherein the wireless transmission is by radio frequency.

10. The apparatus of claim 1 wherein the amount of rotation of the driver is communicated to the processor and the amount of rotation of the cap is calculated by the processor.

11. The apparatus of claim 1 wherein the second monitor comprises an encoder and wherein the amount of rotation of the cap is detected by the encoder.

12. The apparatus of claim 10 wherein the stored range of preferred amounts and values are based on calibrated amounts and values.

13. The apparatus of claim 11 wherein the stored range of preferred amounts and values are based on calibrated amounts and values.

14. The apparatus of claim 1 wherein the stored range of preferred amounts and values are based on calibrated amounts and values.

15. The apparatus of claim 1 wherein the processor designates for rejection containers having caps threaded thereon with monitored torque values and rotation amounts outside of the stored preferred ranges.

16. The apparatus of claim 1 wherein the driver is a servo motor wherein the torque is imparted by the servo motor.

17. The apparatus of claim 16 wherein the imparted torque is adjustable by changing rotational velocity of the servo motor.

18. The apparatus of claim 16 wherein the rotational velocity of the servo motor is incrementally variable up to a predetermined value.

19. The apparatus of claim 16 wherein the servo motor is incrementally variable up to a predetermined value in either a clockwise or a counterclockwise direction.

20. A method for installing a cap having a threaded portion on a container having a threaded portion, the threaded portion of the cap corresponding to the threaded portion of the container, the method comprising:

positioning the cap in supported relation with the container;

imparting a torque to the cap wherein the torque is sufficient to rotate the cap;

rotating the cap with the threaded portion of the cap in engaged relation with the threaded portion of the container at an adjustable rotational velocity;

monitoring the magnitude of the torque imparted to the cap;

monitoring the amount of rotation of the cap;

comparing through operation of a processor the monitored torque and the monitored amount of rotation to stored selected values;

adjusting the rotational velocity of the cap in response to the compared monitored torque and amount of rotation;

maintaining imparted torque until a predetermined amount of rotation is made;

removing imparted torque.

21. The method according to claim 20 wherein the comparing step further includes comparing the monitored torque while comparing the monitored amount of rotation.

22. The apparatus of claim 1 wherein the processor is adapted to compare the monitored torque while comparing the monitored amount of cap rotation.

* * * * *